US009358423B2

(12) United States Patent
Ho et al.

(10) Patent No.: US 9,358,423 B2
(45) Date of Patent: Jun. 7, 2016

(54) ABDOMEN EXERCISE BENCH

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 199 days.

(21) Appl. No.: 14/315,200

(22) Filed: Jun. 25, 2014

(65) Prior Publication Data

US 2015/0375036 A1 Dec. 31, 2015

(51) Int. Cl.
*A63B 23/02* (2006.01)
*A63B 21/00* (2006.01)
*A63B 21/068* (2006.01)

(52) U.S. Cl.
CPC ..... *A63B 23/0222* (2013.01); *A63B 21/00185* (2013.01); *A63B 21/068* (2013.01); *A63B 21/4031* (2015.10); *A63B 21/4035* (2015.10); *A63B 21/4047* (2015.10); *A63B 23/0211* (2013.01); *A63B 2210/50* (2013.01)

(58) Field of Classification Search
CPC ..... A63B 21/1457; A63B 21/1453
See application file for complete search history.

(56) References Cited

U.S. PATENT DOCUMENTS 4,789,152 A * 12/1988 Guerra ..... A63B 21/00047 482/108
8,062,196 B1 * 11/2011 Khubani ..... A63B 23/0211 482/140
8,734,304 B2 * 5/2014 Webber ..... A63B 21/0628 482/140

* cited by examiner

*Primary Examiner* — Loan H Thanh
*Assistant Examiner* — Rae Fischer
(74) *Attorney, Agent, or Firm* — Blakely, Sokoloff, Taylor & Zafman LLP

(57) ABSTRACT

An exercise machine applicable for strengthening a user's abdominal muscles is described. The exercise machine can include a base frame, a backrest assembly and a seat assembly. The base frame can have side members and a crossbar member to provide floor support. The backrest assembly may be rotablely coupled with the base frame to swivel with simultaneous rotational movements around two or more axes of rotations. The backrest assembly can include two or more pairs of pivot joints. Each pair of pivot joints may define one of the axes of rotation. Handle bars may be mounted substantially transverse to the axes of rotation. The seat assembly may be affixed to the base frame to allow a user sitting on a seat pad of the seat assembly to cause the swiveling of the backrest assembly via hand pushes on the handle bars.

14 Claims, 6 Drawing Sheets

300AD

ABDOMEN EXERCISE BENCH

FIELD OF INVENTION

The present invention relates generally to physical training machines, and in particular, exercise machines structured to facilitate swivel movements for exercising the abdominal muscles of a user.

BACKGROUND

With the growing awareness of health problems caused by lack of exercise, popularity of exercising machines has been continuously increasing. Typically, these machines are designed for movements of specific parts of the body. For example, abdominal machines may be structured to induce body exercises to strengthen the abdominal muscles.

Existing abdominal machines, however, are usually designed based on variations of sit-ups exercises. Effective abdominal exercises may require a combination of movements involving muscles of different parts of the body including the waist, legs, etc. Although there are many exercising machines available for exercising different parts of the body, these multipurpose exercising machines are usually heavy and expensive devices. Further, these devices are often designed to provide passive support for simple pivoting movements.

Therefore, traditional abdomen machines are not structured economically and effectively to facilitate a user to exercise abdomen muscles with active supports to induce difficult movements with high strength impacts.

SUMMARY OF THE DESCRIPTION

An exercise machine can be configured with a back support movable in a multi-axis swivel manner to facilitate body forward leaning. Handle bars coupled to the back support can allow a user to exert push pressure to cause the multi-axis swivel movement of the back support for a user to exercise abdominal muscles.

In one embodiment, an exercise machine can include a base frame, a backrest assembly and a seat assembly. The base frame can have side members and a crossbar member to provide floor support. The side members can include a first side member and a second side member. The crossbar member may be transversely coupled between the first and second side members. The backrest assembly may be rotablely coupled with the base frame to swivel with simultaneous rotational movements around two or more axes of rotations. In one embodiment, the backrest assembly can include two or more pairs of pivot joints. At least two of the pairs of pivot joints may be rotablely affixed to the side members. Each pair of pivot joints may define one of the axes of rotation. At least one handle bar may be mounted substantially transverse to the axes of rotation. The seat assembly may be affixed to the crossbar member to allow a user sitting on a seat pad of the seat assembly to cause the swiveling of the backrest assembly via hand pushes on the handle bars.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
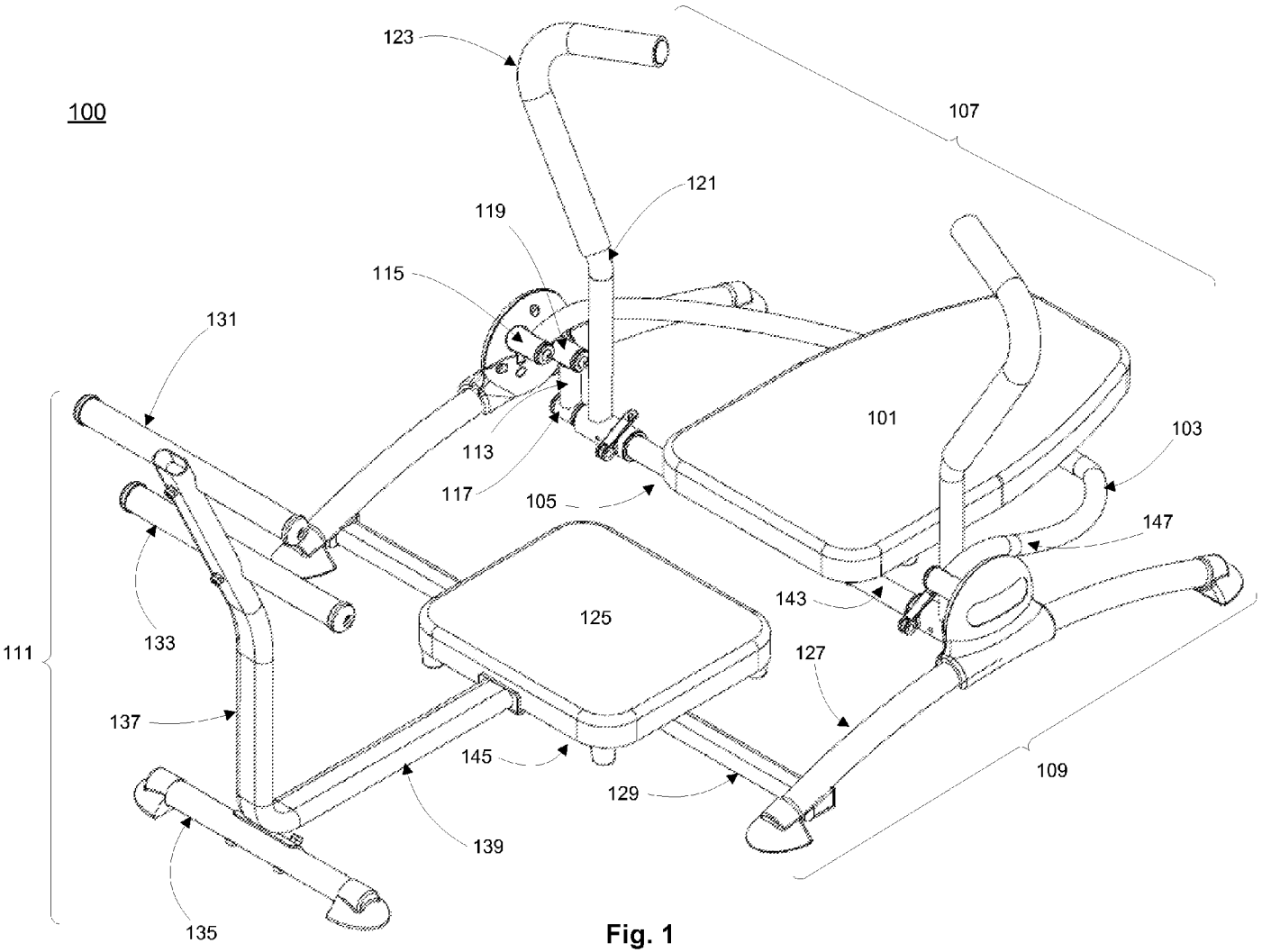
FIG. 1 is a perspective view of an embodiment of an exercise machine assembly.

FIG. 1 is a perspective view of an embodiment of an exercise machine assembly. Exercise machine (or device) 100 can include base frame 109 to provide floor support (and/or sitting support) and backrest assembly 107 rotablely coupled with base frame 109 to move in a swivel pattern to induce effective exercise movements of a user of device 100. The swivel pattern may include three dimensional rotations around multiple axes simultaneously to facilitate the user to lean forward with simple hand pushes.

Base frame 109 may include at least one (e.g. a first and a second) side members 127 and crossbar member 129 transversely coupled in between. Seat assembly 145 including seat pad 125 may be affixed to crossbar member 129 to provide sitting support. Crossbar member 129 and seat pad 125 may be configured at a height close to the ground of base frame 109 to facilitate or compel a user sitting on seat pad 125 to bend his/her knees when performing effective exercise movements for abdominal muscles.

In one embodiment, backrest assembly 107 may be configured or structured in device 100 with two or more axes of rotations transversely to the longitudinal direction of device 100. In other words, backrest assembly 108 may rotate, pivot or swivel back and forth longitudinally along device 100 with simultaneous rotational movements around these multiple axes of rotations, e.g. relative to base frame 109. Backrest pad 101 can move according to a swivel pattern during the swiveling of the backrest assembly 107.

For example, backrest assembly 107 may be configured with two or more pairs of pivot joints, at least two of the pairs of pivot joints rotablely affixed respectively to two side members 127. Each pair of pivot joints can define one of the axes of rotation. Backrest assembly 107 can include at least one handle bar 121 mounted substantially transverse to the axes of rotation. A user sitting on seat pad 125 may cause the swiveling of backrest assembly 107 via hand pushes on handle bars 121.

In one embodiment, backrest assembly 107 can include first swivel structure 105 and second swivel structure 103. First swivel structure 105 may have a first pair of pivot joints 119 pivotally coupled with base frame 109, e.g. via side members 127. Second swivel structure 103 may have guide bar 147 with a second pair of pivot joints 115 pivotally coupled with based frame 109, e.g. via side members 127. First swivel structure 105 may be rotable around a first axis of rotation defined by pivot joints 119. Second swivel structure 103 may be rotable around a second axis defined by pivot joints 115.

Backrest assembly 107 may include backrest pad 101 longitudinally coupled between first swivel structure 105 and second swivel structure 103 to provide active back support (e.g. via multiple axis rotational movements). Backrest pad 101 may be affixed to first swivel structure 105. In other words, backrest pad 101 does not move relative to a portion of first swivel structure. Backrest pad 101 may be movably attached to second swivel structure 103.

Relative positions between backrest pad 101 and second swivel structure 103 may be guided or constrained to produce a swivel movement pattern of backrest pad 101. For example, second swivel structure 103 may be limited or constrained to move longitudinally along backrest seat 101 to cause a swivel pattern in the movement of backrest pad 101.

In one embodiment, first swivel structure 105 may include swivel arms 113 having pivot joints 119 and pivot joints 117 on opposite ends of swivel arms 113. Backrest assembly 107 may include, for example, three pairs of pivot joints 115, 117, 119 (e.g. a first pair, a second pair and a third pair of pivot joints).

First swivel structure 105 may include backrest bar 143 rotablely coupled with swivel arms 113 via pivot joints 117. Backrest pad 101 and handle bars 121 may be affixed to backrest bar 143. Backrest bar 143 may be configured for an axis of rotation of backrest assembly 107 defined by pivot joint 117. First swivel structure 105 may include handle bar 121 substantially transversely (e.g. detachably) affixed to backrest bar 143. For example, one end of handle bar 121 may be configure with latch structure 141 to provide a latching mechanism between handle bar 121 and backrest bar 143. Alternatively, backrest bar 143 may be configured with transversely protruding handle poles to provide a coupling mechanism between handle bar 121 and backrest bar 143 (e.g. with handle bar 121 inserted within or over the handle poles). Other transverse coupling mechanisms between handle bar 121 and backrest bar 143 may be applicable. Hand grip 123 may be inserted over the separate end of handle bar 121 for hand pushes.

In some embodiments, device 100 may include (e.g. optional) extension frame 111 detachably affixed to base frame 109 via seat assembly 145 to provide leg support to a user, for example, when causing backrest assembly 107 to swivel. Extension frame 111 can include standup section 137, extended section 139 and floor bar 135 for floor stand. One or more hooking rods 131, 133 may be transversely affixed along standup section 137 for resting user feet. Extended section 139 may be coupled with seat assembly 145 to provide the longitudinal length of extension frame 111.

Figure 2:
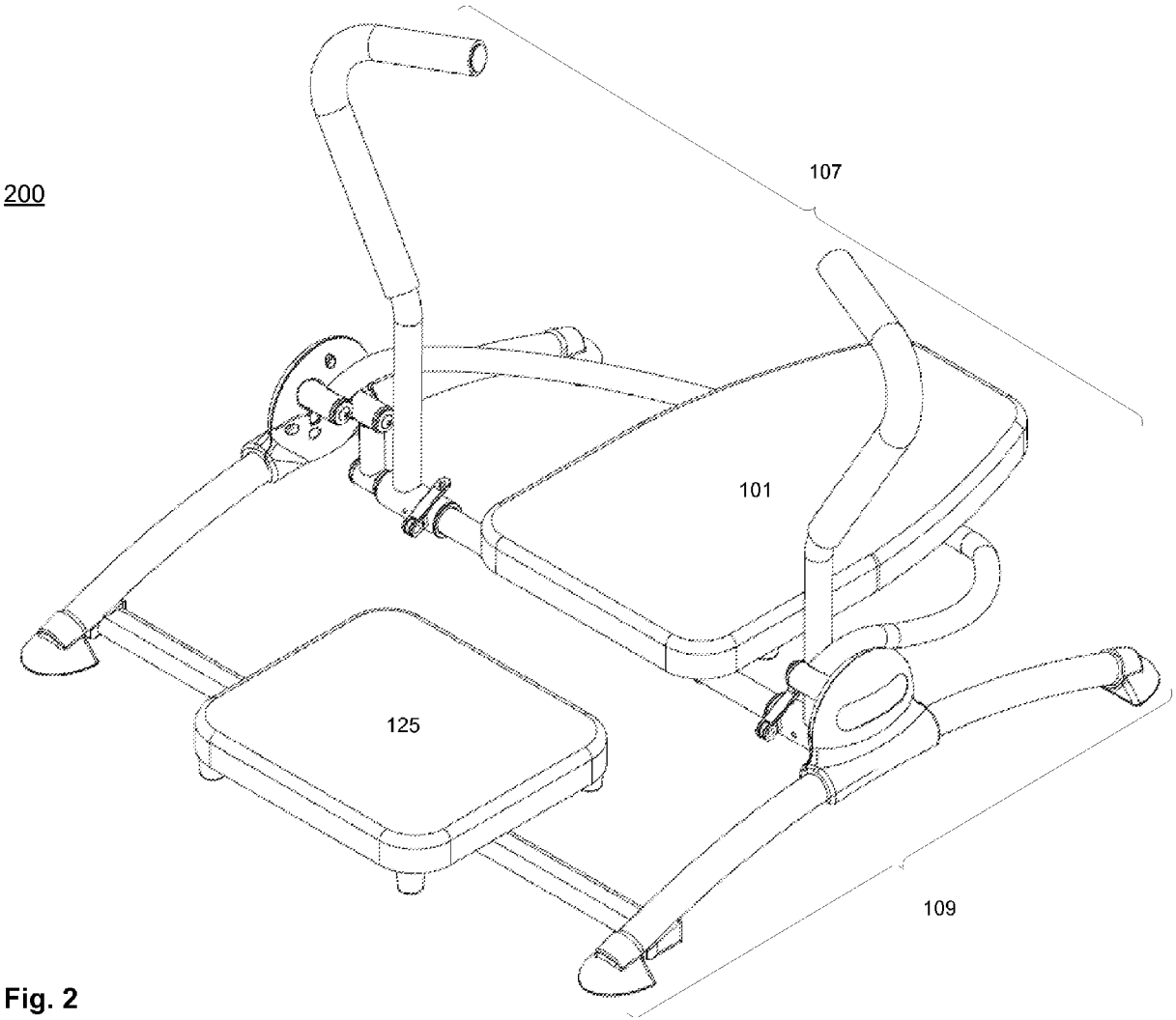
FIG. 2 is a perspective view of an alternative embodiment of an exercise machine assembly.

FIG. 2 is a perspective view of an alternative embodiment of an exercise machine assembly as shown in FIG. 1. For example, device 200 may be configured with base frame 109 and backrest assembly 107 without an optional extension frame.

Figure 3:
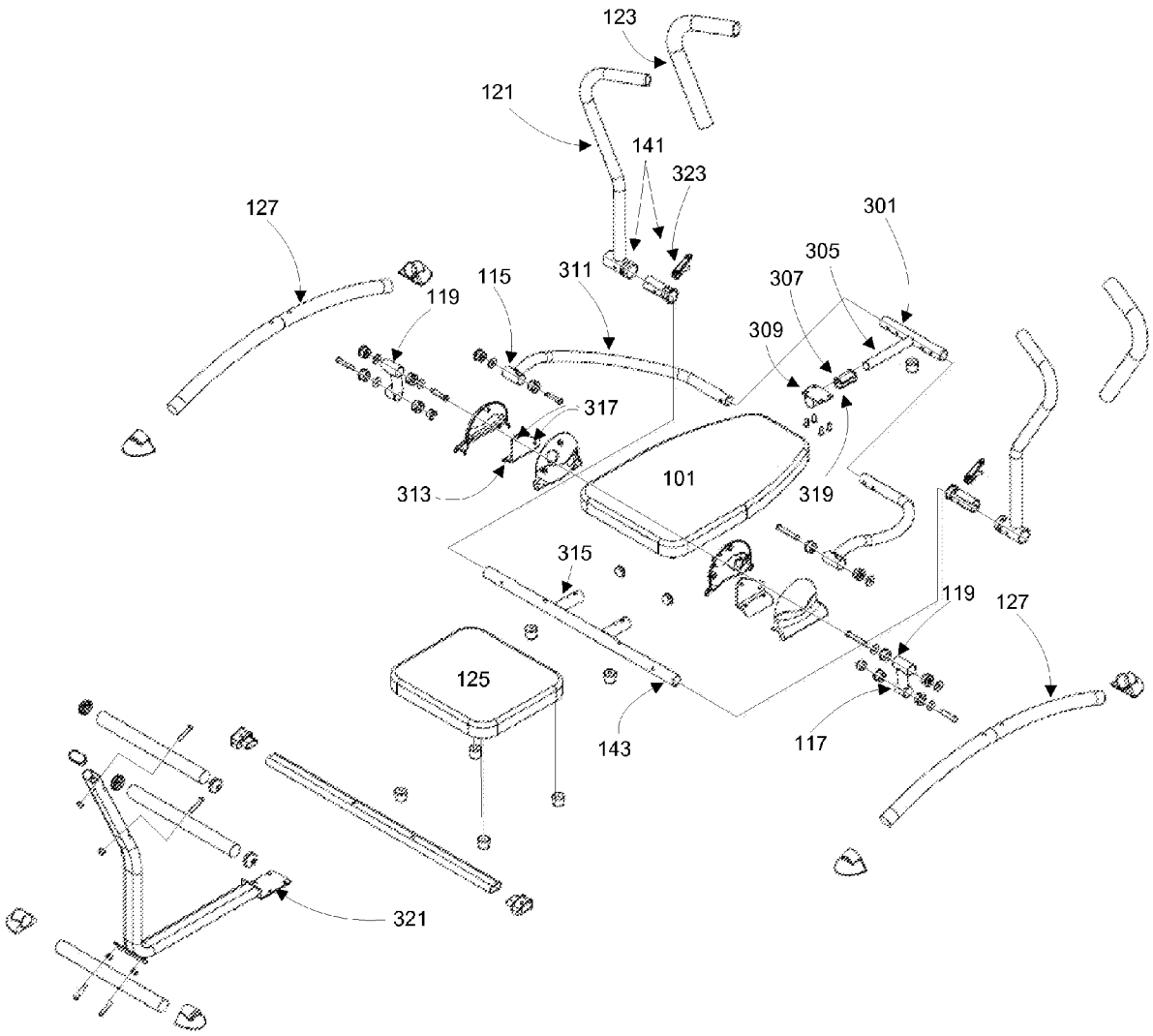
FIG. 3 is an exploded perspective view of an embodiment of an exercise machine assembly.

FIG. 3 is an exploded perspective view of an embodiment of an exercise machine assembly as shown in FIG. 1. For example, base frame 109 and backrest assembly 107 may be coupled via coupling bracket 313 mounted on each side member 127. Extension frame 111 may be removablely affixed to seat pad 125 via bracket 321. Coupling bracket 313 may be defined with two or more pivoting positions 317. Two or more pairs of pivot joints of backrest assembly 107 may be pivotally coupled with side members 127 via pivoting positions 317.

In one embodiment, one or more support bars 315 may be transversely affixed to backrest bar 143 in a substantially coplanar manner (e.g. aligned with a surface of backrest pad 101). The backside of backrest pad 101 may be affixed to first swivel structure 105 via support bars 315. Latch structure 141 may include buckle control handle 323 to tighten or loosen a latch pin (not shown) transversely inserted through backrest bar 143. Latch structure 141 may engage backrest bar 143 with handle bars 121 to longitudinally form an angle with a plane defined by back support bars 315 (or backrest pad 101). A substantially common angle may be formed between each handle bar and the plane. Multiple insertion positions may be defined longitudinally along backrest bar 143 for the insertion of the latch pin of latch structure 141 to allow adjustment of engagement positions between backrest bar 143 and handle bars 121.

In some embodiments, second swivel structure 103 may include slide bar 305 transversely affixed to guide bar 147. Second swivel structure 103 may be movably coupled (or connected) with first swivel structure 105 via coupling structure 319 affixed to the back of backrest pad 101. Coupling structure 103 can include guide sleeve 307 with slide bar 305 slidably inserted within to provide a movement constraint between guide bar 147 and the backrest pad for movement in a swivel pattern. Guide sleeve 307 and slide bar 305 may be longitudinally aligned with backrest pad 101.

Guide bar 147 may include support arms 311 configured with pivot joints 115 and middle section 301 longitudinally affixed with support arms 311. Slide bar 305 may be transversely affixed to middle section 301 to provide guiding constraints for relative movements between first swivel structure 105 and second swivel structure 103.

Figure 3B:
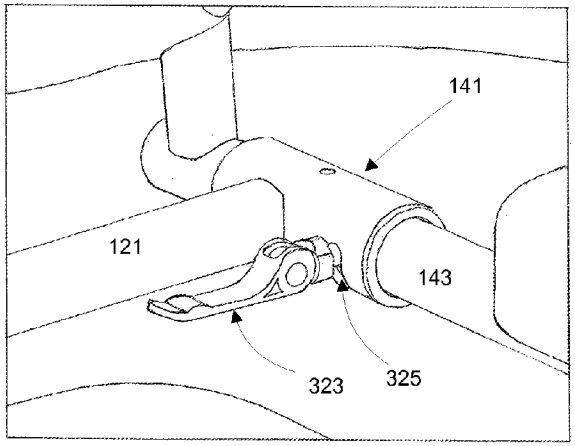
FIGS. 3A-3D are exemplary diagrams illustrating configurations of an exercise machine assembly via buckle controls according to one embodiment of the present invention.
Figure 3D:
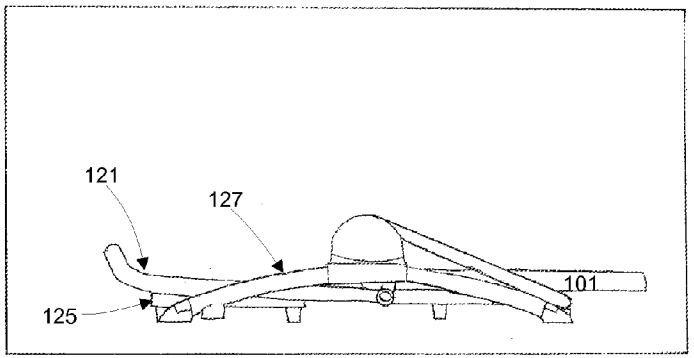
Figure 3A:
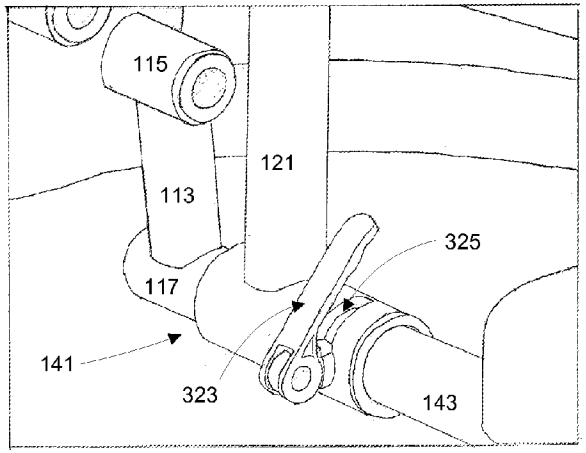

FIGS. 3A-3D are exemplary diagrams illustrating configurations of an exercise machine assembly via buckle controls according to one embodiment of the present invention. For example, diagram 300AD may be based on device 200 of FIG. 2. Turning now to FIG. 3A, buckle control handle 323 may be switched on (e.g. via a handle) in a tightened position to secure engagement between handle bar 121 and backrest bar 143. In one embodiment, trench opening 325 may be defined on latch structure 141 to allow folding of handle bar 121 when disengaged from swivel arm 113. As shown in FIG.

3B, handle bar 121 may be configured in a folded position with buckle control handle 323 switched off (e.g. to allow handle bar 121 to rotate around backrest bar 143 within trench opening 325 without engaging swivel arm 113).

Figure 3C:
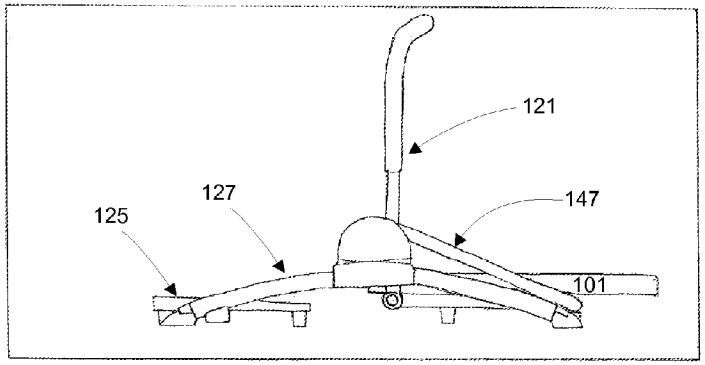

Turing now to FIG. 3C, handle bar 121 may be configured to be secured or engaged with backrest bar 143 in an operating configuration ready for exercise movements. Buckle control handle may be tightened as in FIG. 3A in the operating configuration. With buckle control handle loosened, such as illustrated in FIG. 3B, handle bar 121 may be pivoted, for example, forwardly down, in a folded configuration to reduce space requirement when the exercise device is not in use. For example, as shown in FIG. 3D, handle bar 121 may be configured in the folded configuration substantially leveled with seat pad 125 for storage convenience. Buckle control handle may control configurations between handle bars 121 and backrest bar 143. When buckle control handle is switched on (e.g. tightened), handle bars 121 may be affixed to the backrest bar 143. Alternatively, handle bars 121 may be rotably attached to backrest bar 143 when buckle control handle 323 is switched off (e.g. loosened).

Figure 4A:
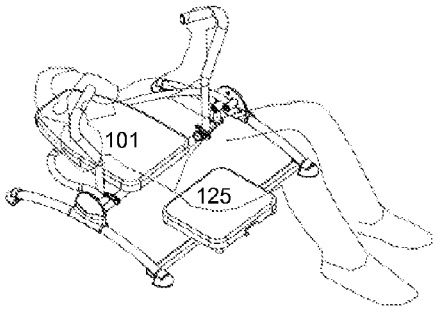
FIGS. 4A-4F show examples of an application of an exercise machine according to one embodiment of the present invention.
Figure 4B:
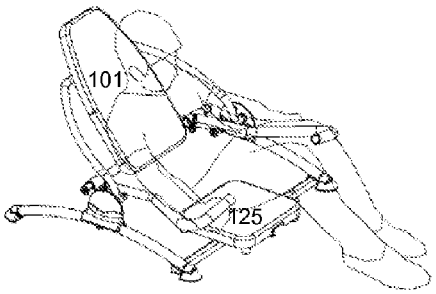
Figure 4C:
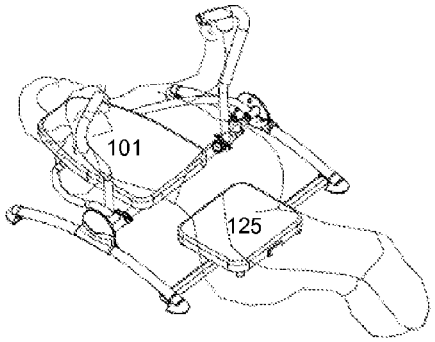
Figure 4D:
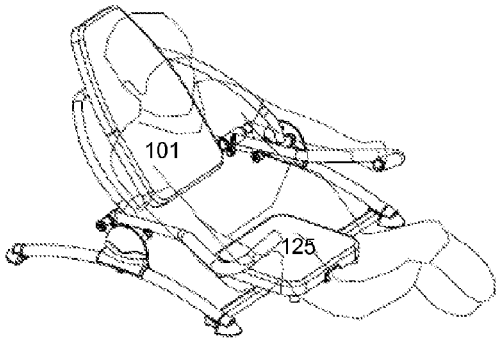
Figure 4E:
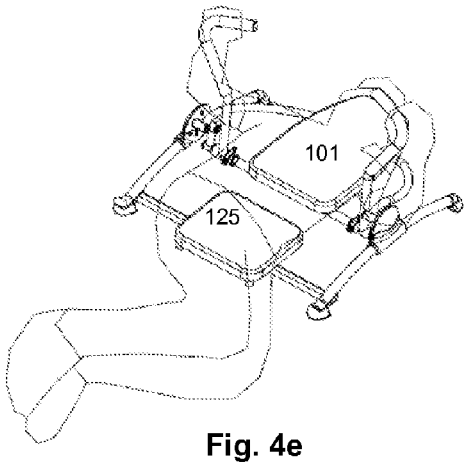
Figure 4F:
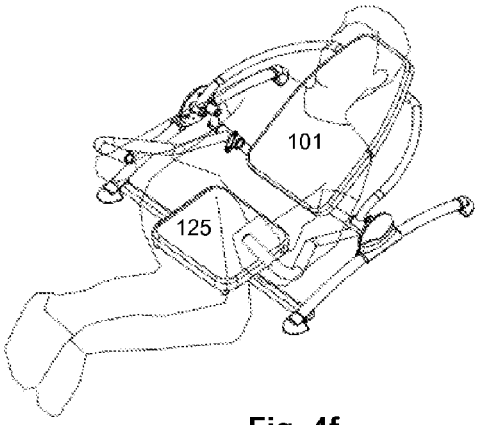

FIGS. 4A-4F show examples of an application of an exercise machine according to one embodiment of the present invention, such as device 200 of FIG. 2. Turning now to FIGS. 4A-4B, a user can sit on seat pad 125 with the user's back resting on backrest pad 101, knees bent and feet on the floor. Handle bars may be grasped with forward pressure via hand push force. As a result, backrest pad 101 can swivel forward with bottom of backrest pad moving backward in a multiple axes rotational movement in a swivel manner to push the whole body of the user leaning forward while maintaining the knees bent. The user can pull handle bars back to return back to a back resting position. Abdominal muscles can be effectively strengthened via repeated exercise movements of the swivel manner induced via the exercise machine Turning now to FIGS. 4C-4D, a user can sit on seat pad 125 with the user's back resting on backrest pad 101, knees bent towards the right side, feet on the floor. The user can perform similar exercise movements as shown in FIGS. 4A-4B while maintaining knees bent towards the right side. FIGS. 4E-4F illustrate similar application of the exercise machine as in FIGS. 4C-4D while maintaining knees bent towards the left side.

Figure 5A:
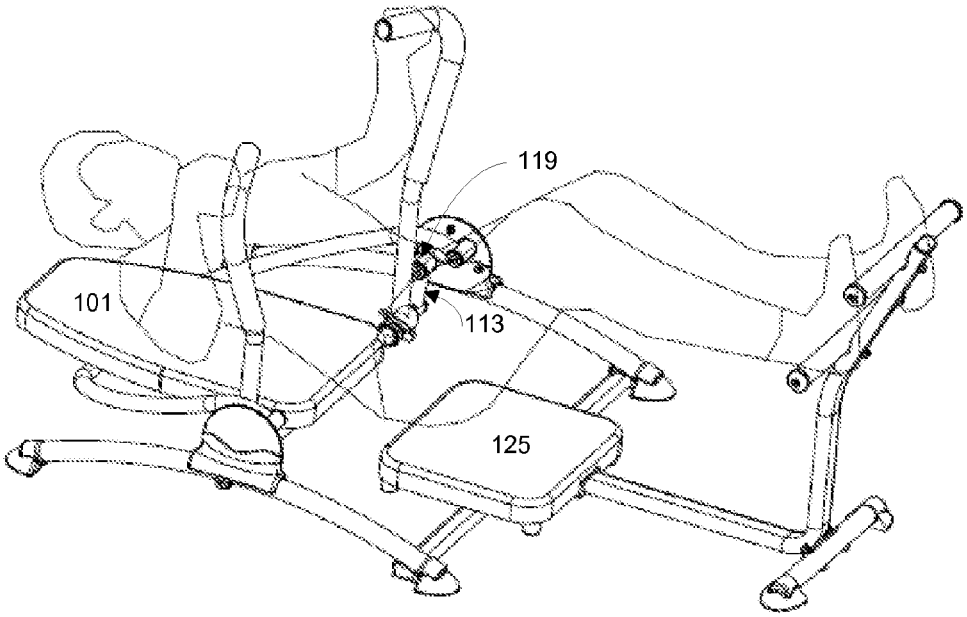
FIG. 5A-5B show alternative examples of application of an exercise machine according to one embodiment of the present invention.
Figure 5B:
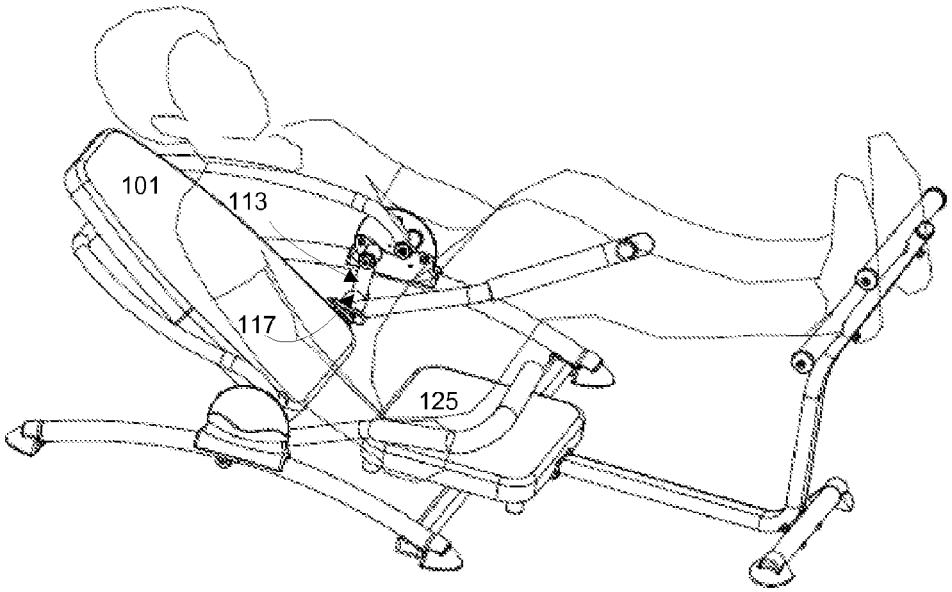

FIG. 5A-5B show alternative examples of application of an exercise machine according to one embodiment of the present invention, such as device 100 of FIG. 1. A user can sit on seat pad 125 with the user's back resting on backrest pad 101, knees slightly bent and feet on hooking rods 131, 133 of extension frame 111. Handle bars may be grasped with forward pressure via hand push force to facilitate the user to perform similar movements as in FIG. 4A-4B with user's knees slightly bent. Swivel arms 113 may swing backwards around multiple pivot joints 119, 117 in FIGS. 5A-5B as a result of constrained movements between first swivel structure 105 (including backrest pad 101) and second swivel structure 103.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising machine consisting of:

a base frame comprising a plurality of side members and a crossbar member to provide floor support, the side members including a first side member and a second side member, the crossbar member transversely coupled between the first and second side members;

a backrest assembly rotablely coupled with the base frame, the backrest assembly comprising a plurality of axes of rotations, the backrest assembly configured to swivel with simultaneous rotational movements around the axes of rotations, the backrest assembly comprising:

a plurality of pairs of pivot joints rotablely affixed to the side members, wherein each pair of pivot joints defines one of the axes of rotation, and a handle bar mounted substantially transverse to the axes of rotation; and a seat assembly comprising a seat pad, the seat assembly affixed to the crossbar member to allow a user sitting on the seat pad to cause swiveling of the backrest assembly via hand pushes on the handle bars.

2. The exercising machine of claim 1, wherein the pairs of pivot joints include a first pair of pivot joints and a second pair of pivot joints, the backrest assembly further comprising:

a first swivel structure comprising the first pair of pivot joints, the first swivel structure rotable around a first axis defined by the first pair of the pivot joints;

a second swivel structure comprising the second pair of pivot joints, the second swivel structure rotable around a second axis define by the second pair of the pivot joints; and a backrest pad longitudinally coupled between the first swivel structure and the second swivel structure, wherein the backrest pad is affixed to the first swivel structure, wherein the backrest pad is movably attached to the second swivel structure, wherein the backrest pad moves according a swivel pattern during the swiveling of the backrest assembly, and wherein the second swivel structure is constrained to move longitudinally along the backrest pad to cause the swivel pattern in a movement of the backrest pad.

3. The exercising machine of claim 2, wherein the first swivel structure comprises:

a pair of swivel arms having the first pair of pivot joints and a third pair of the pairs of pivot joints; and a backrest bar rotablely coupled with the pair of swivel arms via the third pair of pivot joints, wherein the backrest pad and the handle bars are affixed to the backrest bar and wherein the backrest bar is configured substantially in parallel with the axes of rotation.

4. The exercising machine of claim 3, further comprising:

one or more support bars transversely affixed to the backrest bar, wherein the backrest pad is affixed to the first swivel structure via the support bars; and a latch structure to provide latching mechanisms to substantially transversely affix the handle bars to the backrest bar, each handle bar having one end configured with the latch structure.

5. The exercising machine of claim 4, wherein the latch structure comprises a buckle control handle to control configurations between the handle bars and the backrest bar, wherein the handle bars are affixed to the backrest bar when the buckle control handle is switched on, and wherein the handle bars are rotably attached to the backrest bar when the buckle control handle is switched off.

6. The exercising machine of claim 4, wherein the support bars are configured in a substantially coplanar manner over a plane transverse to the backrest bar and wherein each handle bar is configured to longitudinally form a common angle with the plane.

7. The exercising machine of claim 4, further comprising:

a hand grip, wherein each handle bar having a separate end opposite to the end fixed to the backrest bar, and wherein the hand grip is inserted over the separate end of each handle bar for the hand pushes on the handle bar.

8. The exercising machine of claim 2, wherein the second swivel structure comprises:

a guide bar having the second pair of pivot joints on two ends of the guide bar;

a slide bar transversely affixed to the guide bar; and a coupling structure affixed to the backrest pad, the coupling structure including a guide sleeve with the slide bar slidably inserted within to provide a movement constraint between the guide bar and the backrest pad for moving in the swivel pattern.

9. The exercising machine of claim 8, wherein the guide bar comprises:

a pair of support arms, each support arm configured with one of the second pair of pivot joints; and a middle section, wherein the support arms are longitudinally affixed to the middle section and wherein the slide bar is transversely affixed to the middle section.

10. The exercising machine of claim 8, wherein the guide sleeve and the slide bar are longitudinally aligned with the backrest pad.

11. The exercising machine of claim 1, wherein a coupling bracket is mounted on each side member, wherein the coupling bracket is defined with a plurality of pivoting positions and wherein the pairs of pivot joints are pivotally coupled with the side members via the pivoting positions.

12. The exercising machine of claim 1, further comprising:

an extension frame detachably affixed to the base frame via the seat assembly to provide leg support to the user for the swiveling of the backrest assembly, wherein the extension frame comprises:

a standup section; and one or more hooking rods transversely affixed along the standup section for footrest.

13. An exercising machine consisting of:

a base frame comprising a plurality of side members to provide floor support;

a backrest assembly configured to swivel with simultaneous rotational movements around two or more axes of rotations relative to the base frame, the backrest assembly comprising:

a first swivel structure having a first pair of pivot joints rotablely coupled with the side members to define a first axis of the two axes of rotation, the first swivel structure having a handle bar mounted substantially transverse to the first axis, a second swivel structure having a second pair of pivot joints rotablely coupled with the side members, the second pair of pivot joints rotablely coupled with the side members to define a second axis of the axes of rotation, and a backrest pad longitudinally coupled between the first swivel structure and the second swivel structure, wherein the backrest pad is affixed to the first swivel structure, wherein the backrest pad is movably attached to the second swivel structure, wherein the backrest pad moves according a swivel pattern during swiveling of the backrest assembly, and wherein the second swivel structure is constrained to moves longitudinally along the backrest pad to cause the swivel pattern in the movement of the backrest pad; and a seat assembly having a seat pad, the seat assembly affixed to a crossbar member to allow a user sitting on the seat pad to cause the swiveling of the backrest assembly via hand pushes on the handle bars.

14. The exercising machine of claim 13, further comprising:

an extension frame detachably affixed to the base frame via the seat assembly to provide leg support to the user for the swiveling of the backrest assembly.

* * * * *